US008184846B1

(12) United States Patent
Craine

(10) Patent No.: US 8,184,846 B1
(45) Date of Patent: May 22, 2012

(54) BED AUDIO ENTERTAINMENT DEVICE

(76) Inventor: Dean A. Craine, Bellevue, WA (US)

( * ) Notice: Subject to any disclaimer, the term of this patent is extended or adjusted under 35 U.S.C. 154(b) by 590 days.

(21) Appl. No.: 12/365,807

(22) Filed: Feb. 4, 2009

Related U.S. Application Data

(60) Provisional application No. 61/063,477, filed on Feb. 4, 2008.

(51) Int. Cl.
*H04R 1/02* (2006.01)

(52) U.S. Cl. ..... 381/388; 368/322

(58) Field of Classification Search ..... 381/388; 368/223
See application file for complete search history.

(56) References Cited

U.S. PATENT DOCUMENTS

D452,164 S * 12/2001 Buss ..... D10/14

* cited by examiner

*Primary Examiner* — Roy Potter
(74) *Attorney, Agent, or Firm* — Dean A. Craine

(57) ABSTRACT

An audio control device for use by one or two individuals lying in bed. The device includes a flat outer housing with two display surfaces aligned in opposite directions to face the two individuals when placed between them. Located inside the outer housing are two audio control units. Each audio control unit is connected to at least one input port, and an audio output port. An earphone, pillow speaker or a speaker wing component may be attached to each output port. An external audio source may be connected to each input port. Each control unit may include an illuminated display is mounted on each display surface. A volume switch is provided that enables the user to adjust the volume of sound heard. Mounted inside the outer housing is an optional internal audio source and an optional recording/playback unit and one or more mute buttons.

18 Claims, 7 Drawing Sheets

BED AUDIO ENTERTAINMENT DEVICE

This is a utility patent application which claims benefit of U.S. Provisional Application No. 61/063,477, filed on Feb. 4, 2008.

BACKGROUND OF THE INVENTION

1. Field of the Invention

This invention pertains to portable radios and MP3 players, and more particularly to such devices specifically designed for use in a bed.

2. Description of the Related Art

Many couples who sleep in a single bed fall asleep listening to a nightstand radio. Because one person may want to sleep or read and not want to listen to the radio or to a particular station chosen by the other person, many individuals listen to the radio with an earphone or pillow speaker.

If a person is unable to sleep, he or she usually tries to lay still and avoid movements or activities that will disturb the other person. One activity that often wakes up the other person is the act of turning on a radio or turning the radio to different radio stations.

Radio programs typically run for several consecutive hours during the day and night. Typically, the programs include entertainment segments that are divided by commercials and news breaks that are one to five minutes in length. The commercials and news breaks normally occur at regular intervals in the program. The lengths of the commercials and new breaks in the program are typically the same each day. To a frequent listener of the program, listening to the same commercials in the program repeated every hour and every day, can be very annoying. Therefore, one or more mute buttons that are conveniently located on a radio that can selectively mute the sound for predetermine length of time, would be highly desirable.

What is needed is an audio entertainment device that can be used by one or both individuals lying in a bed that enables one or both individuals to selectively operate and listen to different audio sources which does not disturb the other person trying to sleep or read. What is also needed is an audio entertainment device that can selectively mute during commercials or news casts during certain programs.

SUMMARY OF THE INVENTION

An audio entertainment device designed for use by one or more individuals lying in bed that allows one or two individuals lying in the bed to share or independently listen to one or a plurality of different audio sources. The device includes a flat outer housing designed to lie on the bed's mattress or bedding while one or two individuals lie in the bed. During use, the outer housing is positioned on the bed's mattress or bedding in between two individuals lying side-by-side. Formed on the outer housing are two display surfaces oriented in opposite directions so that one display surface may be visible to each individual lying on their sides in a bed. The display surfaces are located on the sides of the outer housing so that each individual facing one display surface is unable to see the opposite display surface facing the other individual.

Mounted inside the outer housing are two, separately controlled audio control units. Each audio control unit includes an auxiliary output port designed to connect to a standard earphone, a pillow speaker, a speaker wing component, a volume control switch, and at least one input port. During use, the input port may be selected connected to an external audio source, such as a nightstand radio, a satellite receiver, an MP3 player or an Internet radio receiver. In preferred embodiment, each control unit includes two or more input ports so that several external audio sources may be connected. The audio control units are connected to a main control switch that enables a user to choose to listen to different external audio source sources connected to the device and to selectively exchange or share external audio sources with the other user. Also, in the preferred embodiment, an illuminated clock is mounted on each display surface so that the user may determine the time during the night.

In a second embodiment, the audio entertainment device includes at least one built-in internal audio source, such as an AM/FM radio, satellite receiver, MP3 player or Internet radio receiver. The two audio control units may be connected to the same internal audio source or they may be connected to two separately operated internal audio sources. When the device includes two or more different internal audio sources, a main control switch may be provided that enables one or both users to select different built-in internal audio sources or to selectively exchange or share internal audio sources.

Mounted on the display surface is a display. Each internal audio source is connected to the display so that the user may manually select different internal audio sources, select different modes of operation or select different stations or channels.

In both embodiments, an earphone, a pillow speaker or a speaker wing component may be connected to the audio output plug for each audio control unit.

Also, a built-in recorder and playback unit is provided for the audio control entertainment unit that allows the users to selectively record/playback audio signals from the external and internal audio sources.

Also, optional mute buttons coupled to each audio control unit may be provided that mute the sound through the output ports.

DESCRIPTION OF THE PREFERRED EMBODIMENT

Figure 1:
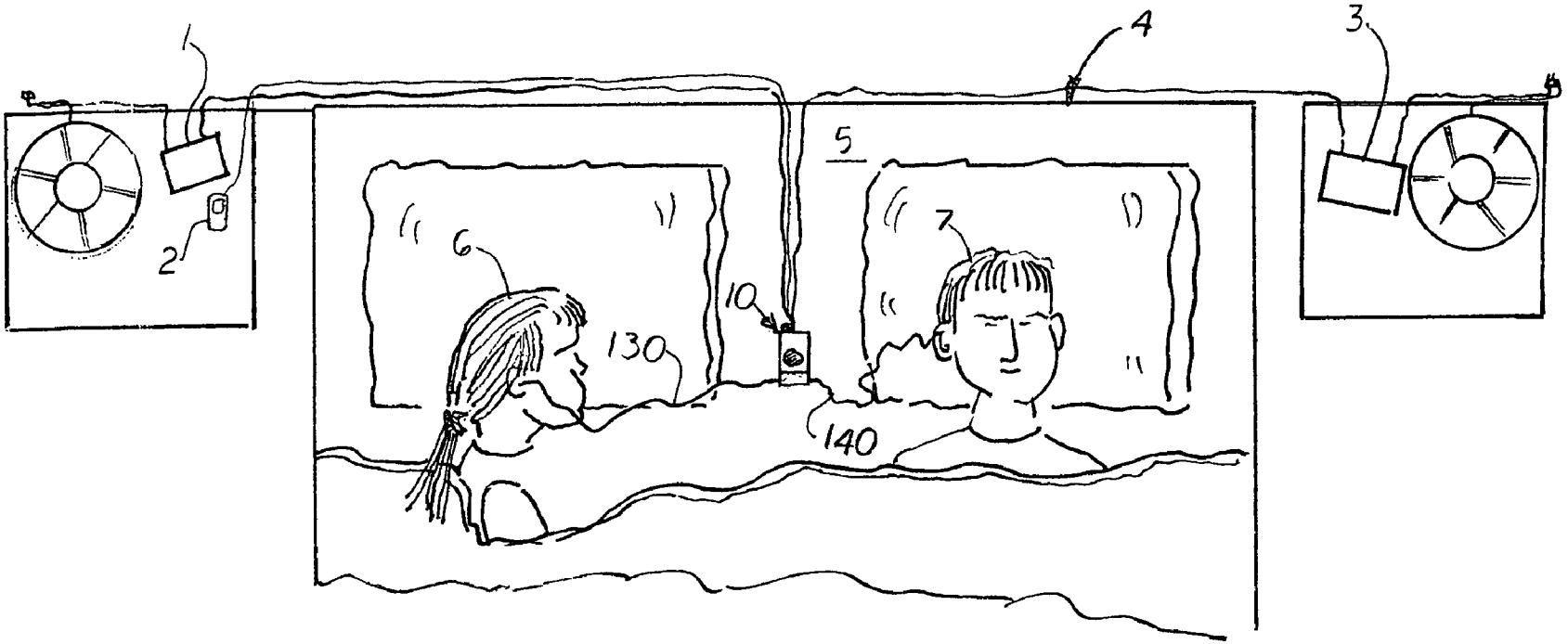
FIG. 1 is an illustration of two individuals sleeping side by side in a bed with the bed audio entertainment device located between them with the two individuals listening to earphones connected to the two entertainment units located inside the device.

There is shown in the accompanying FIGS. 1-11, a bed audio entertainment control device 10 designed for use by one or two individuals 6, 7 lying in bed 4. The device 10 includes a low profile outer housing 12 with a top surface 14, two parallel side surfaces 16 and 18, front and back surfaces 20, 22, and a flat bottom surface 24. In the preferred embodiment, the body's bottom surface 24 is sufficient in width and in length so that the body 12 will lie flat on the bed's mattress 5. Also, the two side surfaces 16 and 18 are perpendicularly aligned with the top and bottom surfaces 14, 24, respectively.

Mounted inside the outer housing 12 are two, separately controlled audio control units 25, 25'. Each audio control unit 25, 25' includes at least one auxiliary output port 27, 27', respectively, designed to connect to a standard male plug 132 on an earphone 130, on a pillow speaker (not shown), or on a speaker wing component 150 (see FIG. 9). Each audio control unit 25, 25' also includes a volume control switch 29, 29', and at least one input port 30, 30', respectively. In the preferred embodiment, each audio control unit 25, 25' has a plurality of input ports 30 and 30' located on the back surface 22 that can be selectively connected to male plugs 134, 134', 134" commonly used on different external audio sources 1, 2, 3, respectively. Such external audio sources 1, 2, 3 may include a nightstand radio, a satellite receiver, an MP3 player or an Internet radio receiver.

The audio control units 25, 25' are connected to a main control switch 36, 36' that enables each user to listen to different external audio sources connected to one of the input ports 30 or 30'. The switches 36, 36' also allows users to selectively exchange or share external audio sources 1, 2, 3 connected to the input ports 30 on one audio control unit 25 with the input ports 30' on the other audio control unit 25'. Also, in the preferred embodiment, each audio control unit 25, 25' is connected to an illuminated clock 38, 38' mounted on each side surface 16, 18 so that the user may determine the time during the night.

Mounted on the top surface 20 is an optional speaker 80 that is selectively connected to each two audio control units 25, 25'. An output control switch 39, 39' is mounted on the side surface 16, 18, respectively, that enables each user to control the production of sound through one or both output ports 27, 27' or to the speaker 80.

FIGS. 4-8 show another embodiment of the device 12 with two AM/FM radios 40, 40', located in each audio control unit 25, 25'. The radios 40, 40' each include a separate AM/FM receiver/tuner 42, 42', respectively. Each radio 40, 40' is connected to an optional display 50, 50' and to an output port 27, 27' mounted on opposite side surfaces 16, 18. Each radio 40, 40' is connected to a main ON/OFF button 70, 70' that allows electrical power to the radio, 40, 40' to be selectively activated and deactivated. Each radio 40 or 40' is connected to a single or dual operating output control switch 82 (similar to switch 36). The switch 82 allows the user to control which radio 40 or 40' delivers a signal to the speaker 80 or to one or both output ports 27, 27'.

Mounted on the opposite side surfaces 16, 18 are the controls used to operate each radio 40, 40', respectively, so that when the device 10 is placed on a mattress 5 between two individuals 6, 7 laying on the mattress 5, the controls may be easily manipulated without disturbing the other individual 6, 7. The controls for each radio 40, 40' include an ON/OFF switch 41, 41', a band control switch 43, 43', a time controlled display illumination control switch 44, 44', a clock or frequency switch 45, 45', a volume control switch 47, 47', up or down tuner control switches 48, 49 and 48', 49', a volume control switch 52, 52', one or more station memory switches 53-57, 53'-57', and an automatic turn off switch 58, 58'.

Figure 2:
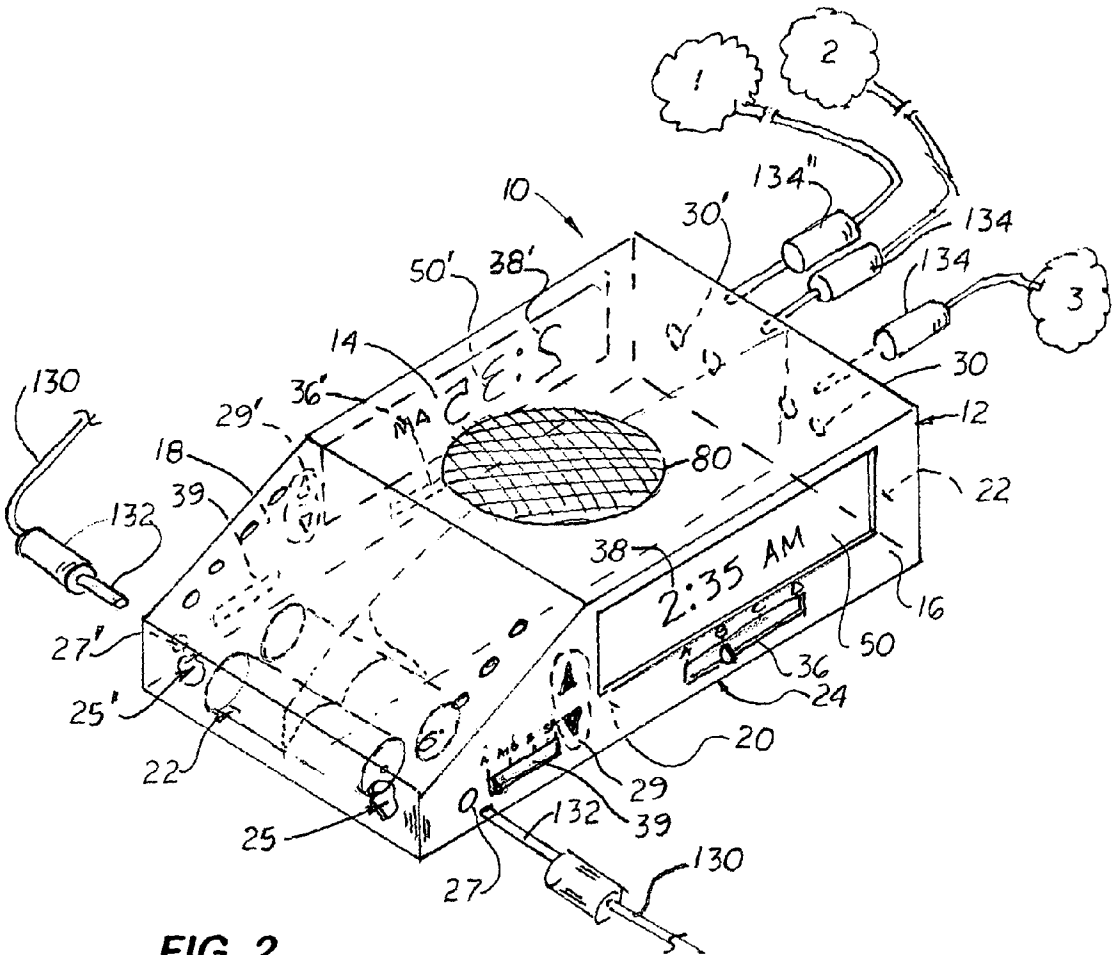
FIG. 2 is a perspective view of an audio entertainment device connected to three external audio sources.
Figure 3:
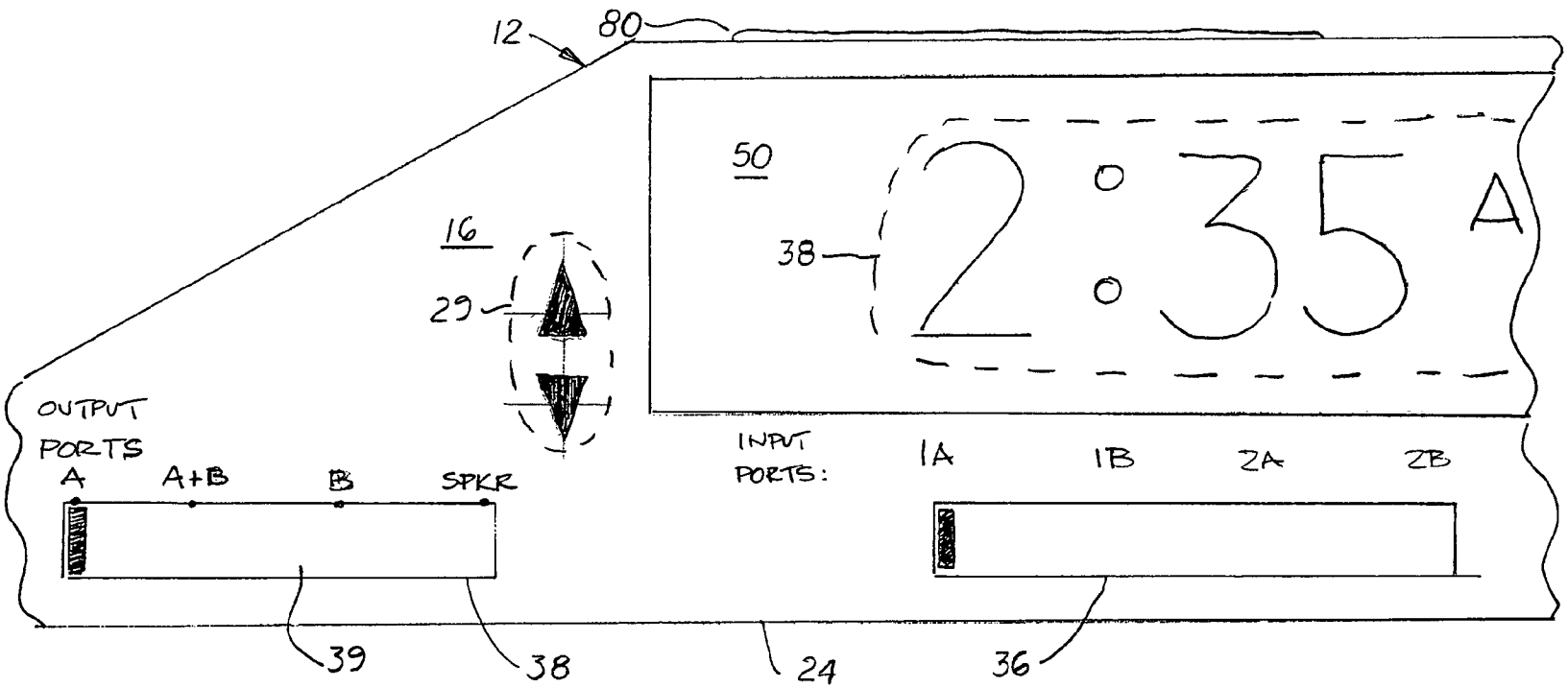
FIG. 3 is a top plan view of a second embodiment of the bed audio entertainment device.
Figure 4:
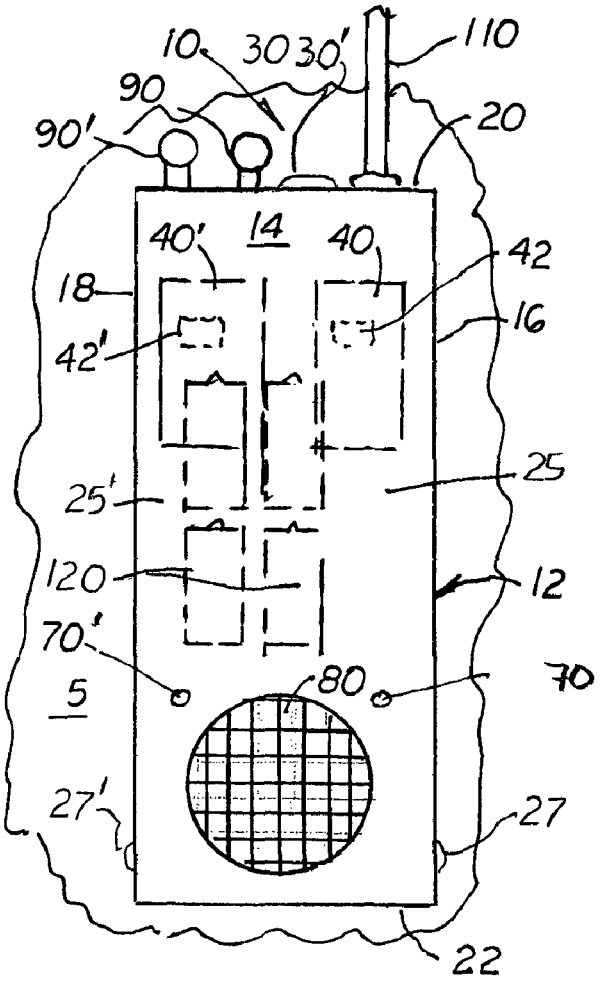
FIG. 4 is a bottom plan view of the bed audio entertainment device shown in FIG. 3.
Figure 5:
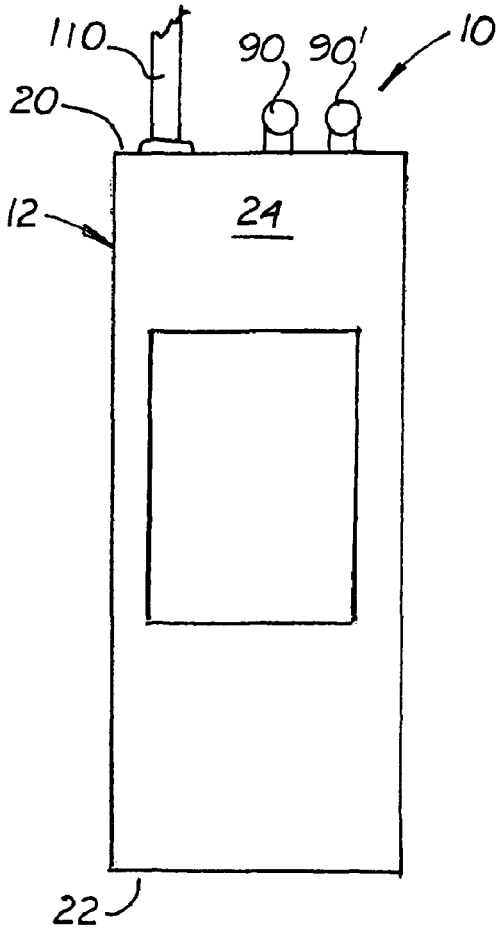
FIG. 5 is a right side elevational view of the invention shown in FIG. 3.
Figure 6:
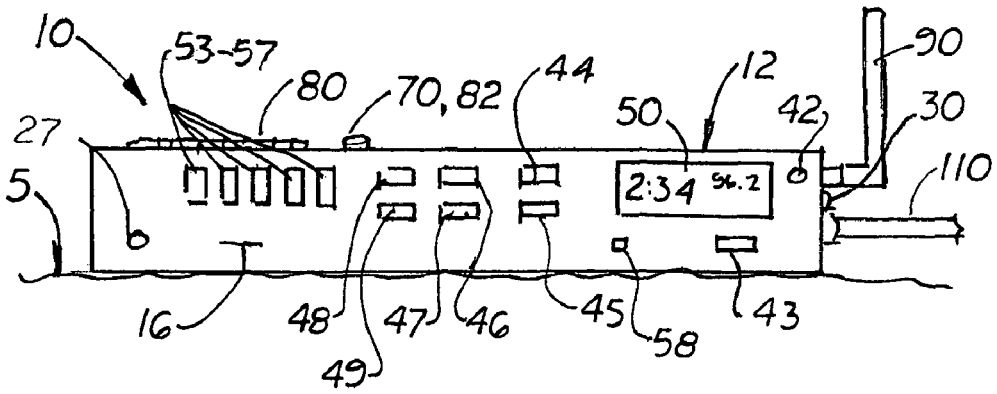
FIG. 6 is a left side elevational view of the invention shown in FIG. 3.
Figure 7:
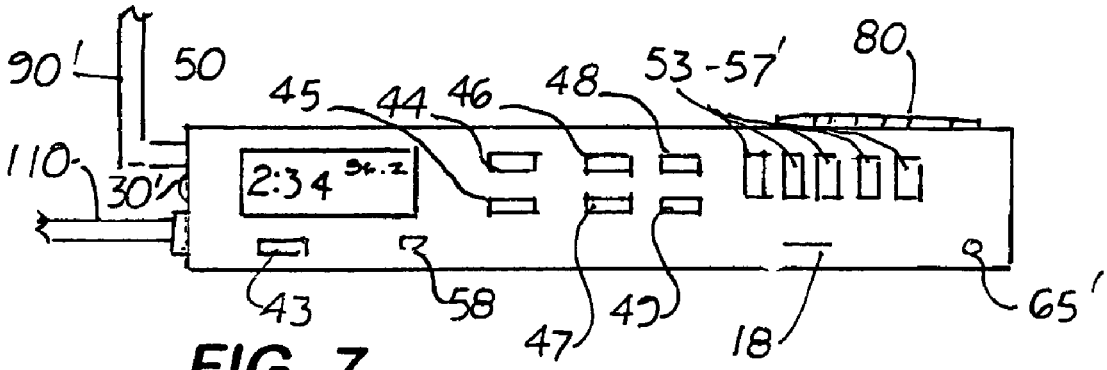
FIG. 7 is atop end elevational view of the invention shown in FIG. 3.
Figure 8:
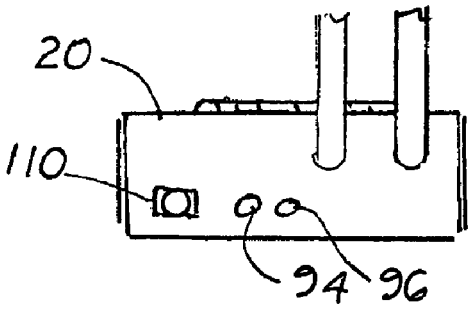
FIG. 8 is a bottom end elevational view of the invention shown in FIG. 3.
Figure 9:
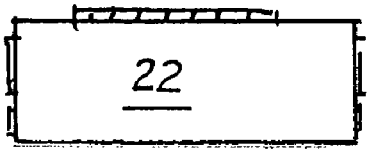
FIG. 9 is an illustration of the second embodiment of the device placed between two individuals lying side by side in a bed with two wing speakers attached and extending laterally from the device.
Figure 10:
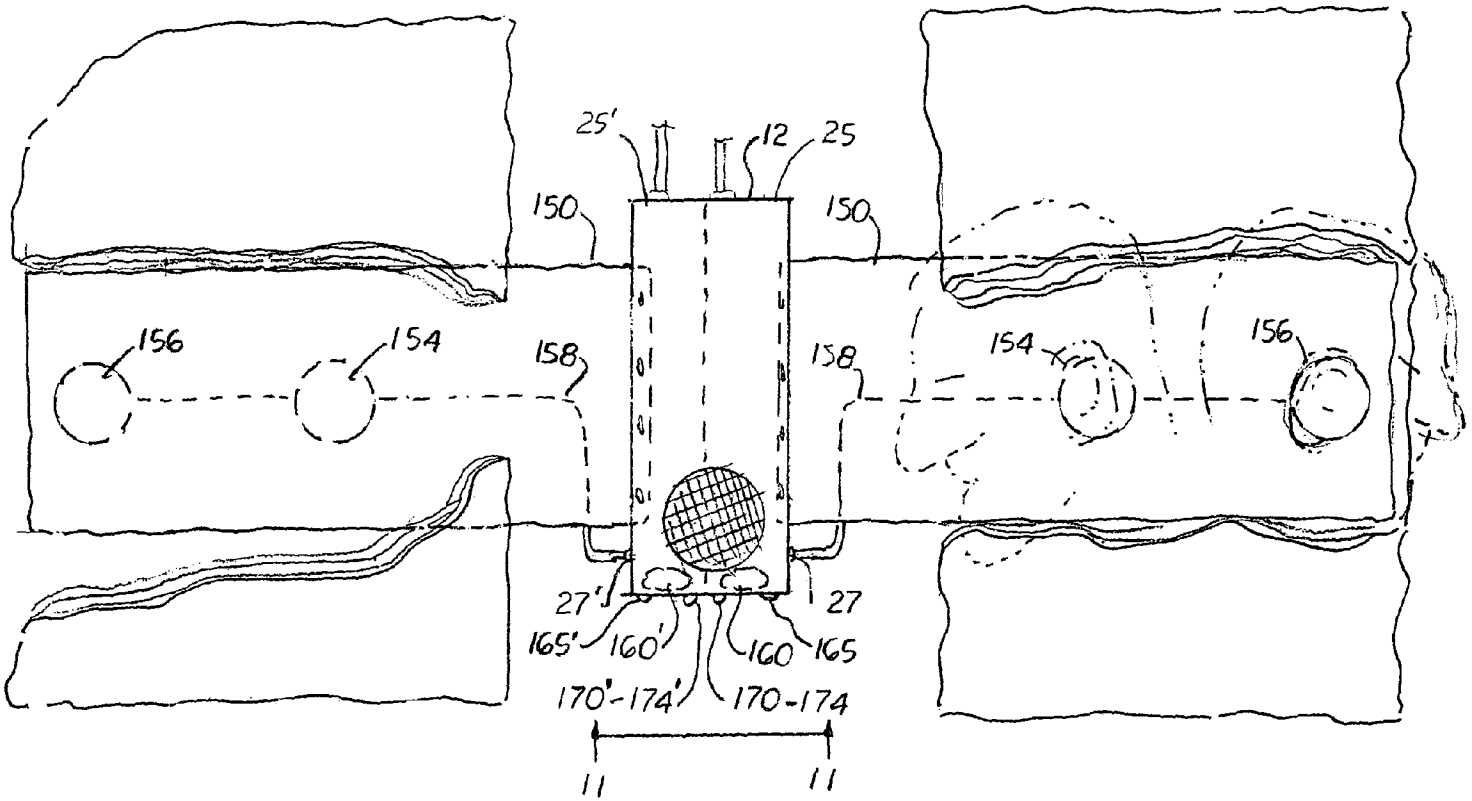
FIG. 10 is a top plan view showing the device attached to two wing speaker components.
Figure 11:
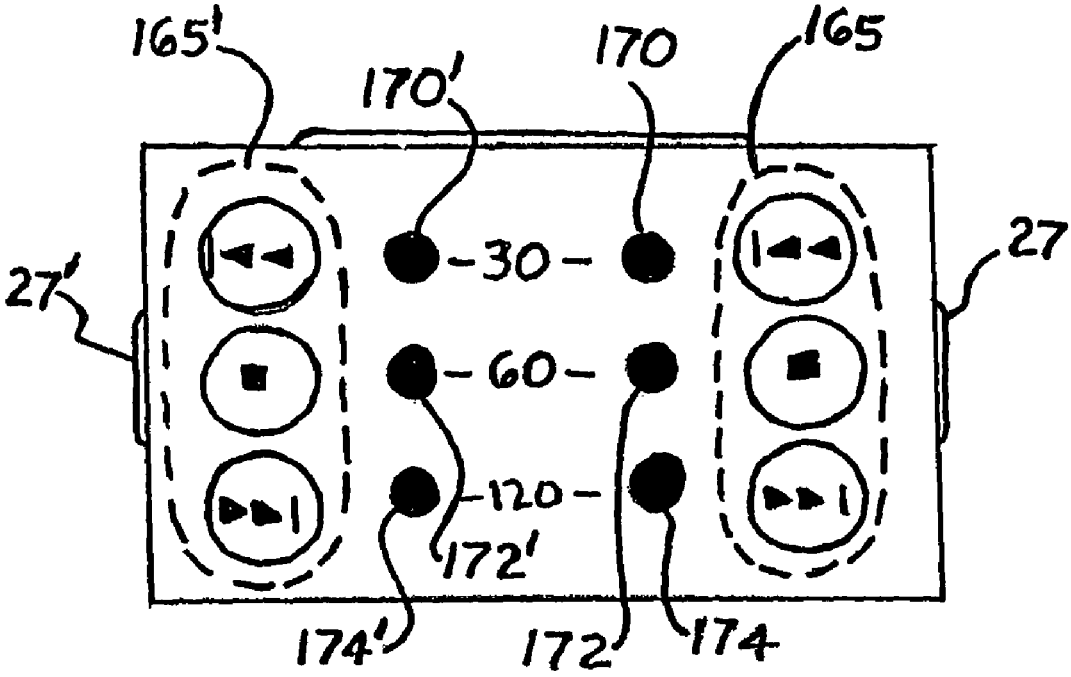
FIG. 11 is an elevation view of the device taken along line 11-11 in FIG. 10.

The first embodiment of the device shown in FIGS. 1 and 2 may include one or two batteries 120. The second embodiment of the device has greater electrical power demands and therefore may be electrically energized by a 115 volt A.C. power cord 110, a D.C. adapter or a large number of batteries 120 housed inside the body 12.

Each radio 40, 40' may be connected to a separate antenna 90, 90' that extends from one end of the body 12. One or two auxiliary input plug-ins 30, 30' may be provided to allow the signal from an external source, such as the audio sources 1, 2, 3, shown in FIG. 1. The device 10 may include a built-in audio tape playback unit, a built-in MP3 player, a built-in satellite receiver unit and a wireless network receiver (not shown).

In both embodiments, an earphone 130, a pillow speaker (not shown) or a speaker wing component 150 may be connected to the audio output ports 27, 27' on the opposite side surfaces 16, 18. Each speaker wing component 150 includes an elongated body 152 with one or two built-in speakers 154, 156. A wire 158 extends from the two speakers 154, 156 to a plug that connects to an audio output port 27, 27'. In the preferred embodiment, the elongated body 152 is made of flexible material (i.e. fabric) and designed to fit under or over the pillow. The two speakers 154, 156 are spaced apart and longitudinally aligned on each body 152 so that a speaker 154 or 156 is positioned directly under the ear when the user rolls from side-to-side over the pillow.

Also, in both embodiments a built-in recorder/playback unit 160, 160' is provided for each audio control unit 25, 25' that allows the users to selectively record and playback audio signals from the external and internal audio sources. A set of controls 165, 165' for controlling the recording playback unit 160, 160' are mounted on the front face of the device 12.

Optional mute buttons 170, 172, 174 and 170', 172', and 174' are also provided for to each audio control unit 25, 25', respectively, that enables the user to selectively mute the sounds provided to the earphones 130, 130' or speaker 80. In the preferred embodiment, the mute buttons 170, 170' are time restricted to automatically release the muting feature after a predetermined time period (30 seconds, 60 seconds, 120 seconds).

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A bed audio entertainment device positioned between two individuals laying side-by-side on a bed, comprising:

a. a flat outer housing with a wide flat bottom surface, and two opposing side surfaces locate on opposites sides of said outer housing and each facing an individual laying side-by-side on a bed;

b. at least one internal or external audio source;

c. two audio control units located inside said outer housing and each separately coupled to said internal or external audio source, each said audio control unit includes at least one input port and at least one audio output port, said audio control units and said input ports and said output ports being configured so that sounds from said internal or external audio source may be separately heard through one said output port or heard through both said output ports d. an ear hearing device selectively connected to each said audio output port so that sounds from said internal or external audio source may be heard, said ear hearing device extending laterally from said outer housing and towards an individual laying adjacent to said outer housing.

2. The bed audio entertainment device, wherein said audio source is one of the following items: an AM/FM radio, a satellite receiver, MP3 player and an Internet connected radio.

3. The bed audio entertainment device, as recited in claim 1 further including at least one mute button used to mute the sound from said internal or external audio source.

4. The bed audio entertainment device, as recited in claim 1 further including a built-in recorder and playback unit.

5. The bed audio entertainment device, as recited in claim 1, wherein said internal and external audio source-is an internal AM/FM radio.

6. The bed audio entertainment device, as recited in claim 1, further including a main control switch used to selectively connect said audio control units to said audio source.

7. The bed audio entertainment device, as recited in claim 5, further including a built-in recorder and playback unit.

8. The bed audio control device, as recited in claim 7, further including a main control switch that enables a user to select different audio sources or share an audio source with the other individual.

9. A bed audio control device, comprising:

a. an outer housing with a wide flat bottom surface and two opposite side surfaces that are parallel to each other and configured to face one individual when placed in between two individuals laying side by side in a bed;

b. at least one AM/FM radio located inside said outer housing, said AM/FM radio includes a ON/OFF switch, an AM/FM mode switch, a radio signal adjustment switch, said AM/FM radio includes an illuminated display mounted on at least one said side surface;

c. two audio output ports each mounted on one of said side surfaces;

d. a volume control switch; and, e. two earphones connected to said audio output ports, each said earphone being configured to extend laterally from said outer housing and separately worn by two individuals lying side by side in a bed.

10. The bed audio entertainment device, as recited in claim 1, further including a speaker mounted on said outer housing.

11. The bed audio entertainment device, as recited in claim 10, further including a dual operating control switch that controls the delivery of sound signals to said speaker and said output ports.

12. The bed audio entertainment device, as recited in claim 1, further including a clock mounted on said outer housing.

13. The bed audio entertainment device, as recited in claim 12, wherein said clock is mounted on each said side surface on said outer housing.

14. The bed audio entertainment system, as recited in claim 3 wherein said mute button is time restricted that automatically releasing the muting feature after a predetermined time period.

15. The bed audio entertainment system, as recited in claim 1 further including each audio control unit including a volume control switch.

16. The bed audio entertainment system, as recited in claim 1 wherein said ear hearing device is a set of earphone plugs or a pillow speaker.

17. The bed audio entertainment system, as recited in claim 1 wherein said ear hearing device is a speaker wing component.

18. The bed audio entertainment system, comprising:

at least one external audio source;

an audio control device that includes two opposite side surfaces, at least one input port connected to said external audio source, two audio control units each including an output port, each said audio control unit being connected to said input port so that sound from said external audio source and delivered to said input port may be selectively delivered to said outport port;

an ear hearing device connected to each said two output port to deliver sound from said external audio source to an individual laying adjacent thereto.

* * * * *